US006479972B1

(12) United States Patent
Chen

(10) Patent No.: US 6,479,972 B1
(45) Date of Patent: Nov. 12, 2002

(54) VOLTAGE REGULATOR FOR SUPPLYING POWER TO INTERNAL CIRCUITS

(75) Inventor: Issac Y. Chen, Hsinchu (TW)

(73) Assignee: Elite Semiconductor Memory Technology Inc., Hsin-chu (TW)

( * ) Notice: Subject to any disclaimer, the term of this patent is extended or adjusted under 35 U.S.C. 154(b) by 0 days.

(21) Appl. No.: 09/659,574

(22) Filed: Sep. 11, 2000

(51) Int. Cl.[7] ..... G05F 1/618

(52) U.S. Cl. ..... 323/266; 323/267; 323/271; 323/282

(58) Field of Search ..... 323/282, 284, 323/285, 267, 268, 272, 274, 275, 269, 271; 327/74

(56) References Cited

U.S. PATENT DOCUMENTS 5,408,172 A * 4/1995 Tanimoto et al. ..... 323/273
5,557,193 A * 9/1996 Kajimoto ..... 323/266
5,889,392 A * 3/1999 Moore et al. ..... 323/282
5,977,755 A * 11/1999 Miki et al. ..... 323/269
6,084,386 A * 7/2000 Takahashi et al. ..... 323/273
6,201,374 B1 * 3/2001 Ater et al. ..... 323/267

* cited by examiner

*Primary Examiner*—Jeffrey Sterrett
*Assistant Examiner*—Gary L Laxton
(74) *Attorney, Agent, or Firm*—Birch, Stewart, Kolasch & Birch, LLP

(57) ABSTRACT

A regulator for supplying the power of internal circuits, which makes the power of internal circuits independent of the voltage of the outlet power supply by using multi-stage method to control the power supplied from the outlet power source, and avoids the dropping of voltage to affect the system operation. The voltage is able to return to the normal voltage level quickly by increasing the voltage level of the internal circuits in advance, and make the voltage of the internal power supply reduce the variation when output and return to normal voltage level quickly when charge by dynamic adjusting the loading in the regulator.

13 Claims, 6 Drawing Sheets

VOLTAGE REGULATOR FOR SUPPLYING POWER TO INTERNAL CIRCUITS

BACKGROUND OF THE INVENTION

1. Field of the Invention

The present invention relates to a voltage regulator for supplying power to internal circuits; more particularly, the invention relates to a voltage regulator capable of supplying power to the internal circuits of a DRAM IC.

2. Description of the Prior Art

The conventional regulator is often used to supply the sensing voltage (referred to as Vsa hereinafter) of bit lines in a DRAM IC.

First, the circuit structures of a prior art is explained as follows with reference to FIG. 1A, which shows a circuit diagram of the prior art. As shown in FIG. 1A, a operation amplifier 1 is connected to a PMOS transistor M1, which has input terminals 5 and 7 for receiving signals from the reference voltage and Vsa, respectively, such that the input terminal 7 is further connected to a node 3 to receive the voltage of the node 3. The operation amplifier 1 is used for comparing the voltage of the node 3 (referred to as Vsa hereinafter) and a reference voltage. Take a 2.7V reference voltage as an example, when the Vsa is larger than 2.7V, the operation amplifier 1 will output a high voltage. signal. When the Vsa is lower than 2.7V, the operation amplifier 1 will output a low voltage signal. The source of the PMOS transistor M1 is used for receiving the output of the external power supply Vdd (such that the Vdd equals 5V, for example), and the drain of the PMOS transistor M1 is connected to a loading device Csa at the node 3. The loading device Csa is connected between the node 3 and the ground. Wherein, the node 3 is connected to the input 7 of the operation amplifier 1 and outputs the Vsa, and the loading device Csa is a capacitor.

Next, the operation procedure of the conventional circuit will be described. As mentioned above, the Vsa supplies the sensing voltage of the bit lines in a DRAM IC. When the Vsa is larger than 2.7V, the output of the operation amplifier 1 may go higher and higher to decrease the Ids of the PMOS. transistor M1, wherein the Ids is a current that flows from the source of the PMOS transistor M1 to the drain of the PMOS transistor M1, then less and less charge flows onto the Vsa. When the bit lines sensing current sunk from the Vsa, the Vsa will drop lower and lower, until it is lower than 2.7V, the output of the operation amplifier 1 will go lower to turn on the PMOS transistor M1 to let more charge flowing onto the Vsa.

In other words, by using the operation amplifier 1, the Vsa can be maintained at a stable level.

However, there are some problems in the structure of the conventional circuits.

The first problem in the conventional Vsa design is that the Vsa is affected by vdd. As shown in FIG. 1B, when Vdd gets higher. and higher and exceeds the speed that the operation amplifier M1 can respond to, the supplying charge to the capacitor Csa, in a unit time, is also increased. Consequently, the charging speed of the capacitor Csa gets faster. Therefore, during the continuous charging-discharging process, the increasing Vsa will be too high, hence results in damage of the components of the circuit thereby. The second problem, when the Vsa is applied to sense the bit lines of DRAM, the Vsa is decreased. However, the Vsa of exceedingly low voltage will disable the operation of the DRAM IC. Moreover, because the sensing of a DRAM lasts only a certain period, the value of Vsa must be restored to the normal voltage value within the sensing period of the DRAM to avoid affecting the operation of the DRAM in the next sensing period. So it is important to decrease the recovery. time for Vsa to return to the normal voltage value quickly.

SUMMARY OF THE INVENTION

The object of the present invention is to provide an internal power supply, which has a constant Vsa that do not vary with Vdd. And the internal power supply will raise the voltage level in advance after output to prevent the Vsa from dropping exceedingly low. Moreover, the recovery time of the Vsa is reduced.

To achieve the above-mentioned object, the present invention provides a voltage regulator to supply the power of the circuits in the DRAM IC. The voltage regulator process the voltage source from the external power supply by incorporating multiple buffers to prevent the internal power supply from being influenced by the, external power supply. Before supplying the power to DRAM, by means of increasing the voltage of the internal power supply the voltage of the internal power supply can be stopped from dropping exceedingly low, which will affect the operation of the DRAM IC. Also, a normal voltage level can be regained quickly. The speed for the voltage, to return to the normal voltage level can be achieved by changing the loading of the voltage regulator (excluding the loading of the bit lines) so that the variation of the voltage level during output is decreased as well as, the voltage variation. During charging, the decrease in the loading of the voltage regulator will decrease the recovery time.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE PREFERRED EMBODIMENT

Accordingly, it is an object of the present invention to provide a voltage regulator capable of supplying a stable power to circuits and regaining original voltage level quickly after outputting the power.

To further understand various features of the present invention, the following descriptions are introduced herein as the preferred embodiments of the present invention in reference to the accompanying drawings.

First Embodiment

Figure 1A:
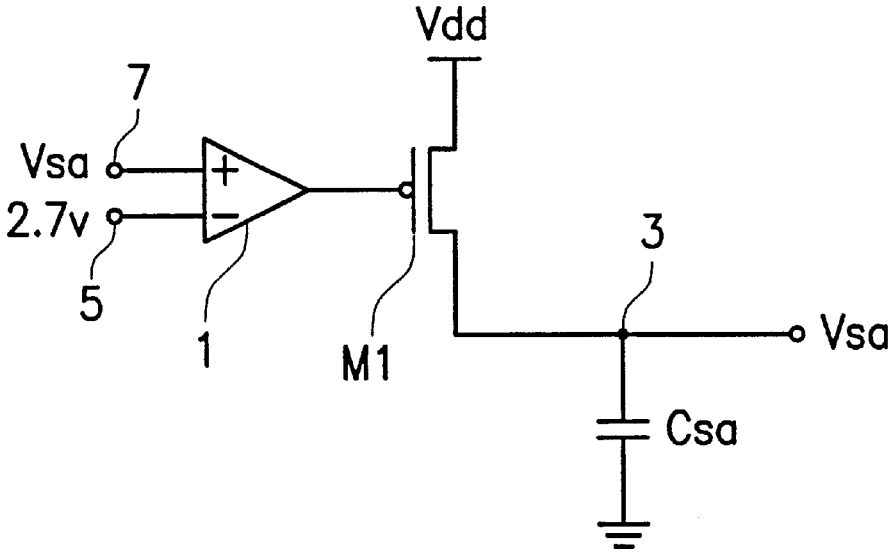
FIG. 1A (PRIOR ART)
FIG. 1A shows a schematic circuit diagram of a prior art.
Figure 1B:
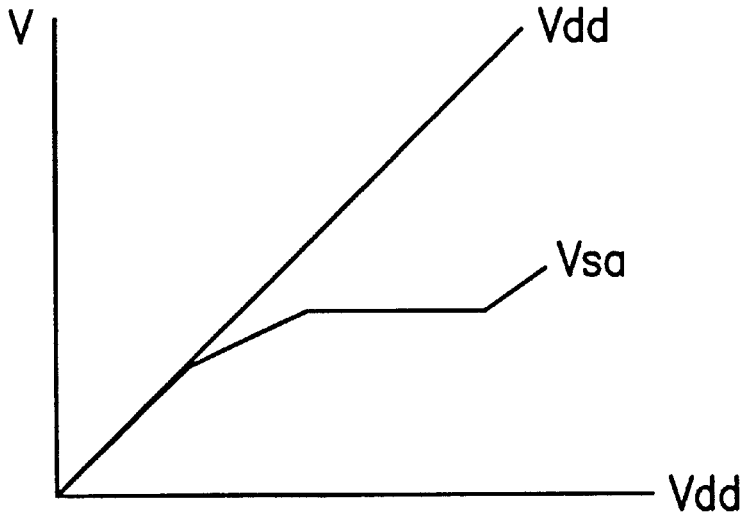
FIG. 1B (PRIOR ART)
FIG. 1B shows a graph in which output voltages are plotted against input voltages according to the prior art.
Figure 2A:
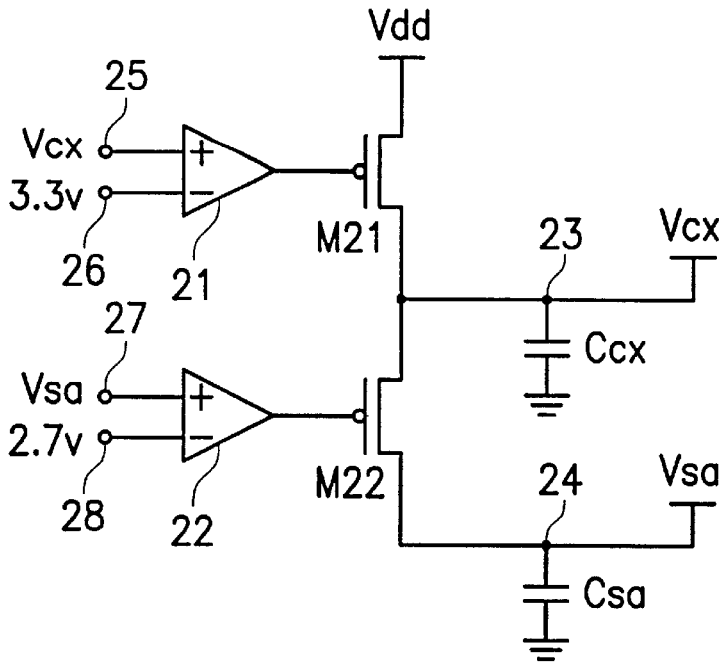
FIG. 2A shows a schematic circuit diagram illustrating the first embodiment of the present invention.

The circuit structure according to the first embodiment of the present invention is described as follows. As shown in FIG. 2A, the operation amplifier 21 is connected to the PMOS transistor M21, which has the input terminal 25 and 26 for receiving the Vcx and the first reference voltage (of 3.3V for example) respectively, wherein the input terminal 25 is further connected to the node 23 to receive the voltage of the node 23(referred to as Vcx hereinafter). The operation amplifier 21 is used for comparing the Vcx and the first reference voltage. When the Vcx is larger than 3.3V, the operation amplifier 21 outputs a high voltage level signal. And when the Vcx is lower than 3.3V, the operation amplifier 21 outputs a lower voltage level signal. The source of PMOS transistor M21 is used for receiving the output of the external power supply Vdd (of 5V for example), and the drain of the PMOS transistor M21 is connected to the second loading device Ccx at the node 23. The second loading device is connected between the node 23 and the ground. Wherein the node.23 is connected to the input terminal 25 of the operation amplifier 21 and outputs Vcx. Furthermore, the second loading device Ccx is a capacitor.

The operation amplifier 22 is connected to the PMOS transistor M22, which has the input terminal 27 and 28 for receiving the Vsa and the second reference voltage(of 2.7V for example) respectively, wherein the input terminal 27 is further connected to the node 24 to receive the voltage of the node 24 (referred to as Vsa hereinafter). The operation amplifier 22 is used for comparing the Vsa and the second reference voltage. When the Vsa is larger than 2.7V, the operation amplifier 22 is in a high voltage level. And when the Vsa is lower than 2.7V, the operation amplifier 22 outputs a lower voltage level signal. The source of PMOS transistor M22 is connected to between the drain of the PMOS transistor M21 and the second loading device Ccx for receiving the Vcx, and the drain of the PMOS transistor M22 is connected to the first loading device Csa at the node 24. The first loading device is connected between the node 24 and the ground. Wherein the node 24 is connected to the input terminal 27 of the operation amplifier 22 and outputs Vsa. Furthermore, the first loading device Csa is a capacitor.

Now describe the operation of the first embodiment of the present invention. The Vcx is used for charging the first loading device Csa. When the Vcx is larger than 3.3V, the output of the operation amplifier 21 may go higher and higher to decrease the Ids of the PMOS transistor M21, wherein the Ids is a current that flows from the source of the PMOS transistor M21 to the drain of the same, then less and less charge flows onto the Vcx. When the current Ids of the PMOS transistor M22 sunk from the Vcx, the Vcx will drop lower and lower, until it is lower than 3.3V, the output of the operation amplifier 21 will go lower to turn on the PMOS transistor M21 to let more charge flowing onto the Vcx.

In the same manner, the Vsa supplies the power for sensing the bit lines of the DRAM IC. When the Vsa is larger than 2.7V, the output of the operation amplifier 22 may go higher and higher to decrease the Ids of the PMOS transistor M22, wherein the Ids is a current that flows from the source of the PMOS transistor M21 to the drain of the same, then less and less charge flows onto Vsa. When the bit lines sensing current sunk from Vsa, the Vsa will drop lower and lower, until it is lower than 2.7V, the output of the operation amplifier 22 will go lower to turn on, the PMOS transistor M22 to let more charge flowing onto Vsa. This will make Vsa go higher to 2.7V.

Therefore, the voltage regulator of the present invention will provide the Vsa that is not very with Vdd by using the Vcx, which is more stable then the Vdd, to charge the first loading device Csa.

Figure 2B:
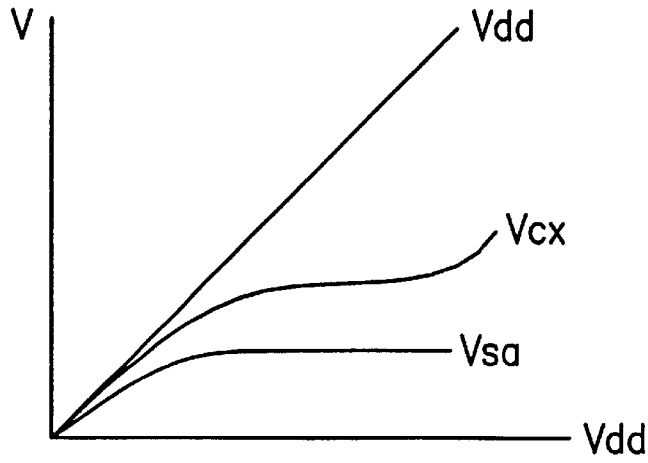
FIG. 2B shows a graph in which output voltages are plotted against input voltages according to the first embodiment of the present invention.

Referring to FIG. 2B, FIG. 2B shows a plot of the output voltage against the each input voltage (Vsa and Vcx). of the first embodiment of the present invention. When the raising speed of the Vdd is quicker than the response speed of the operation amplifier, the Vcx is raising slowly. But the slope of the Vcx is smaller than Vdd. The plot of the Vdd against the Vcx is the same with the plot of the Vdd against the Vsa of the prior art. As the Csa is charged by the Vcx, the Vsa will has fewer relationship with the Vdd. Therefore, the present invention employs the concept of the two-stage stable status for adjusting the output voltage, will cause the more stabilize of the output voltage. However, as described above, we take the two-state stable status as an example, actually, the more states stable status will make the output of the regulator to be more stable.

Second Embodiment

Figure 3A:
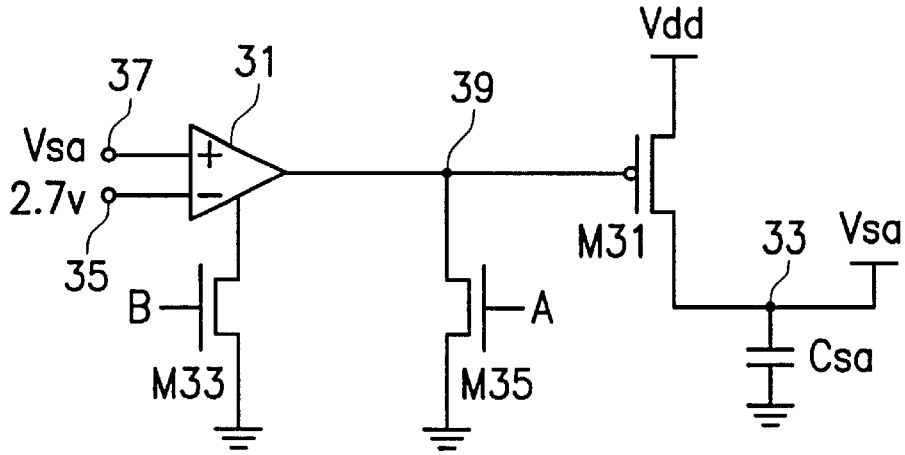
FIG. 3A shows a schematic circuit diagram illustrating the second embodiment of the present invention.

FIG. 3A is the schematic circuit diagram according to the second embodiment of the present invention. As shown in FIG. 3A, the NMOS transistor M33 is a switch for controlling the operation of the operation amplifier 31. When the gate B of the PMOS M33 receives a high level signal, the operation amplifier 31 is enabled. On the contrary, when the gate B of the NMOS transistor M33 is in the low voltage level, the operation of the operation amplifier 31 will be disabled. In the same manner, the NMOS transistor M35 is a switch, which is connected to the node 39 of the PMOS transistor M31 and the operation amplifier 31. When the gate A of the NMOS transistor M35 receives a high voltage level signal, the NMOS transistor M35 will be turned on and makes the gate of the PMOS transistor M31 connect to the ground. When the gate A of the NMOS transistor M35 receives a low voltage level signal, the NMOS transistor M35 will be turned off and the gate of the PMOS transistor M31 is connected to the output of the operation amplifier 31 directly.

The operation amplifier 31 is connected to the node 39 of the PMOS transistor M31 and the NMOS transistor M35, which has the input terminal 35 and 37 for receiving the reference voltage (of 2.7V for example) and the Vsa respectively, wherein the input terminal 37 is further connected to the node 33 to receive the voltage of the node 33. The operation amplifier 31 is used for comparing the Vsa and the reference voltage. When the Vsa is larger than 2.7V, the operation amplifier 31 is in a high voltage level signal. And when the Vsa is lower than 2.7V, the operation amplifier, 31 outputs a lower voltage level signal. The source of PMOS transistor M31 is used for receiving, the output of the external power supply Vdd (of 5V for example), and the drain of the same is connected to the loading device Csa at the node 33. The loading device Csa is connected between the node 33 and the ground. Wherein the node 33 is connected to the input terminal 37 of the operation amplifier 31 and outputs Vcx. Furthermore, the loading device Csa is a capacitor.

Figure 3B:
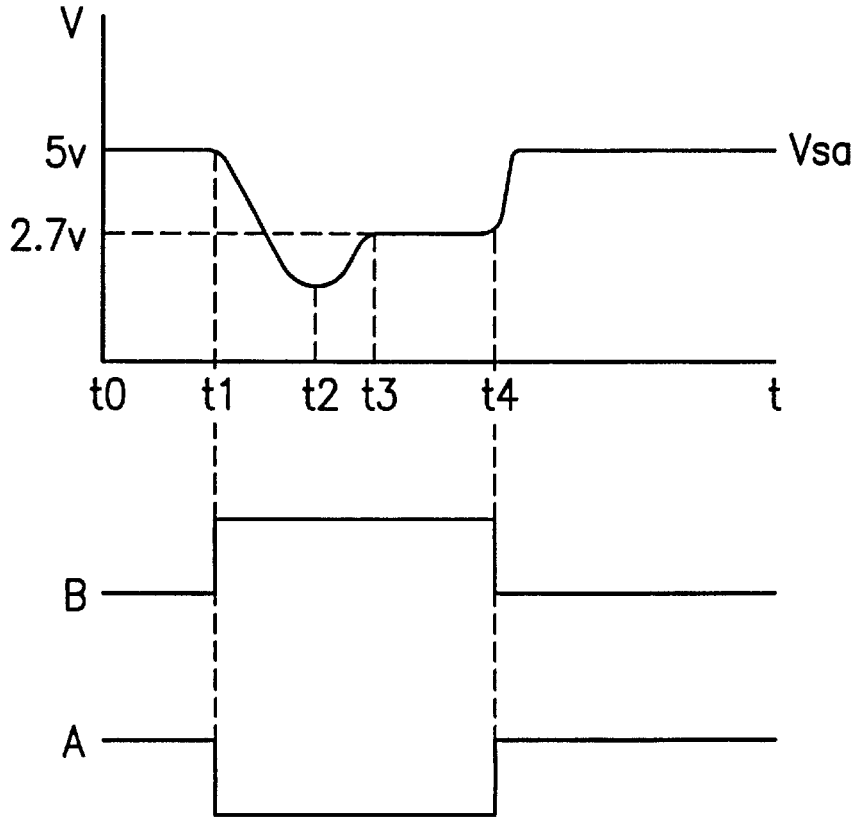
FIG. 3B shows a graph in which output voltages are plotted against input voltages according to the second embodiment of the present invention.

Now describe the operation of the circuit of the second embodiment of the present invention. As shown in FIG. 3B, FIG. 3B shows a plot of the output voltage of the Vsa against the input voltages of the PMOS transistor M33 and the NMOS transistor M35. First, the gate B of the NMOS transistor M33 is in the low voltage level, and the gate A of the NMOS transistor M35 is in the high voltage level. At this time, the operation amplifier 31 is disabled, and the PMOS transistor M31 is turned on because of the node 39 is in the low voltage level. Therefore, the loading device Csa is charged by the Vdd. Referring to FIG. 3B, the voltage of the Vsa is 5V which is the same with the voltage of Vdd. When the Vsa is provided for sensing voltage of the bit lines the voltage of the gate B of the NMOS transistor M33 changes to high voltage level to enable the operation amplifier 31. The gate A of the NMOS transistor M35 changes to low voltage level to turn off the NMOS transistor M35. At this time, the gate of the PMOS transistor M31 is connected to the operation amplifier 31 only. The Vsa goes down because of supplying the power for sensing the bit lines between $t_1$ and $t_2$. When the Vsa is lower than the 2.7V, the operation amplifier 31 outputs a low voltage signal to turn on the PMOS transistor M31, so the Vdd charges the loading device Csa to increase the voltage of the Vsa. When the Vsa is higher than 2.7V, the operation amplifier 31 outputs a high voltage level to turn off the PMOS transistor M31 to stop the operation of charging the loading device Csa. As a result, the operation of charging Csa and the capacitor of the bit lines will causes the voltage of the Vsa raised to 2.7V between the $t_2$ and $t_3$. From $t_3$ to $t_4$, the Vsa is maintained at 2.7V. After $t_4$, because of the voltage of the gate B of the NMOS transistor M33 goes down to the low voltage level, the operation amplifier M31 is disabled. And when the voltage of the gate A of the NMOS transistor M35 goes up to the high voltage level, the NMOS transistor M35 and the PMOS transistor M31 are turned on to charge the Csa by vdd. At this time, the operation amplifier 31 is disabled, so the Vsa will be charging till 5V(the voltage of Vdd).

Increasing the voltage level of the Vsa before supplying the power to the DRAM can prevent the Vsa dropping exceedingly low and makes it easier to charge the Vsa to 2.7V in time before the next sensing period of DRAM. However, the operation of the DRAM IC will be stopped if the Vsa is in an exceedingly low voltage.

The voltage regulator of the second embodiment of the present invention makes the Vsa level equal to 5V at equalization period. Therefore, there are more charge Q for sensing (wherein $Q=C\Delta V$, $\Delta V=V1-V2$, C is the total capacitance of the Csa and the capacitor of the bit lines, V1 is the value of Vsa before sensing and V2 is the minimum value of Vsa after sensing). Obviously, in order to keep the same charge Q and C, so that the $\Delta V$ will be the same. When V1 is increased, V2 will be increased in the same way. Therefore, it means that the second embodiment of the present invention can increase the minimum Vsa higher than the prior art. Because the present invention offers a higher minimum Vsa, the recovery time of the present invention is obviously shorter than the conventional design.

Third Embodiment

Figure 4A:
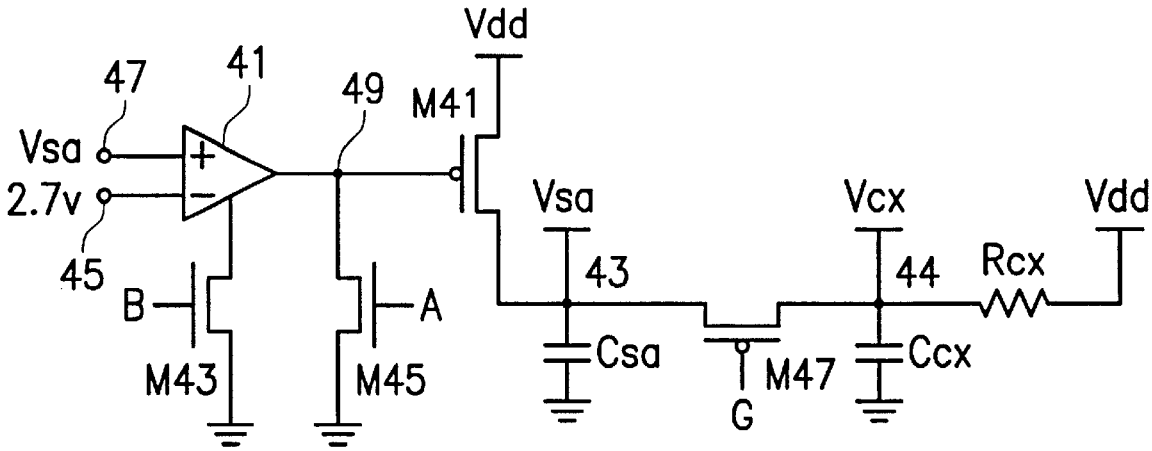
FIG. 4A shows a schematic circuit diagram illustrating the third embodiment of the present invention.

FIG. 4A is the schematic circuit diagram according to the third embodiment of the present invention. As shown in FIG. 4A, the NMOS transistor M43 is a switch for controlling the operation of the operation amplifier 41. When the gate B of the NMOS M43 receives a high level signal, the operation amplifier 41 is enabled. On the contrary, when the gate B of the NMOS transistor M43 is in the low voltage level, the operation of the operation amplifier 41 is disabled. In the same manner, the NMOS transistor M45 is a switch which is connected to the node 49 between the PMOS transistor M41 and the operation amplifier 41. When the gate A of the NMOS transistor M45 receives a high voltage level signal, the NMOS transistor M45 will be turned on and makes the gate of the PMOS transistor M41 connect to the ground. When the gate A of the NMOS transistor M45 receives a low voltage level signal, the NMOS transistor M45 will be turned off and the gate of the PMOS transistor M41 is connected to the output of the operation amplifier 41 directly.

The operation amplifier 41 is connected to the node 49 of the PMOS transistor M41 and the NMOS transistor M45, which has the input terminal 45 and 47 for receiving the reference voltage (of 2.7V for example) and the Vsa respectively, wherein the input terminal 47 is further connected to the node 43 to receive the voltage of the node 43. The operation amplifier 41 is used for comparing the Vsa and the reference voltage. When the Vsa is larger than 2.7V, the operation amplifier 41 is in a high voltage level signal. And when the Vsa is lower than 2.7V, the operation amplifier 41 outputs a lower voltage level signal. The source of PMOS transistor M41 is used for receiving the output of the external power supply Vdd (of 5V for example), and the drain of the same is connected to the first loading device Csa at the node 43. The first loading device Csa is connected between the node 43 and the ground. Wherein the node 43 is connected to the input terminal 47 of the operation amplifier 41 and outputs Vcx. Furthermore, the first loading device Csa is a capacitor.

Moreover, the Vdd is provided to charge the second loading device Ccx (in the form of a capacitor for example) via the third loading device Rcx (in the form of a resister for example). The node 44 is the connection of the second loading device Ccx and the third loading device Rcx, and the voltage is the Vcx thereon.

The PMOS transistor M47 is a switch between the the node 43 and 44. When the gate of the PMOS transistor M47 receives a low voltage signal, the PMOS transistor M47 will be turned on and make the first loading device Csa and the second loading device Ccx are connected in parallel. On the contrary, when the gate of the PMOS transistor M47 receives a high voltage signal, the PMOS transistor M47 will be turned off and separate the first loading device Csa and the second loading device Ccx. Therefore, the first loading device Csa is charged by the Vdd via the PMOS transistor M41 and the second loading device Ccx is charged by the Vdd via Rcx.

Figure 4B:
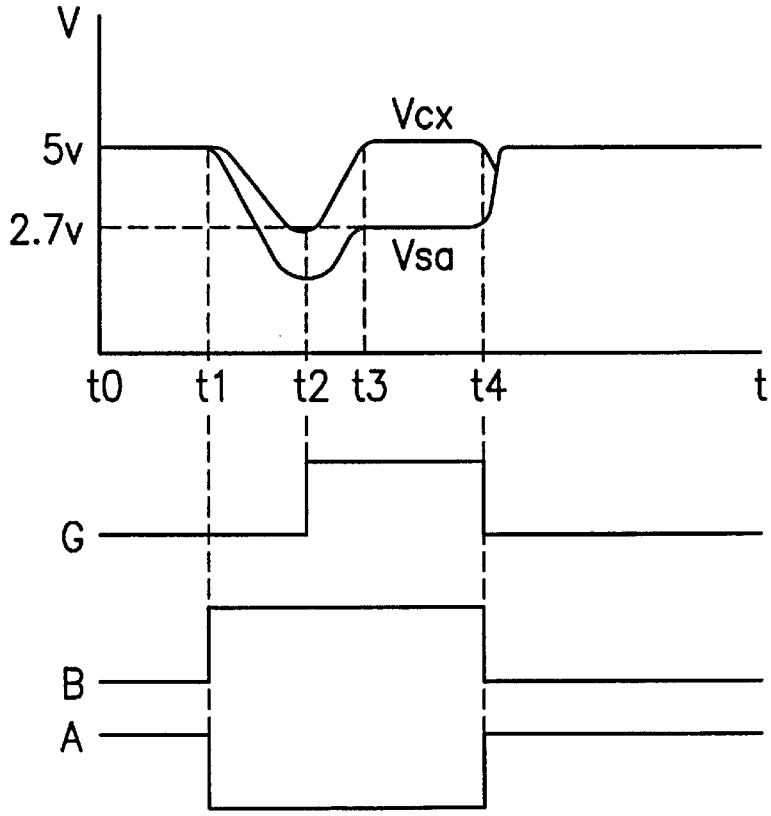
FIG. 4B shows a graph in which output voltages are plotted against input voltages according to the third embodiment of the present invention.

Now describe the operation of the third embodiment of the present invention. FIG. 4B is a plot of the output voltage of the Vsa against the input voltages of the NMOS transistor M43, M45 and the PMOS transistor M47. First, the gate B of the NMOS transistor M43 is in the low voltage level, the gate A of the NMOS transistor M45 is in the high voltage level, and the gate G of the PMOS transistor M47 is in the low voltage level. At this time, the operation amplifier 41 is disabled, and the PMOS transistor M41 is turned on because of the node 49 is in the low voltage level. Furthermore, the gate G of the PMOS transistor M47 is in the low voltage level, hence the PMOS transistor M47 is turned on and results in the parallel connection of the first loading device Csa and the second loading device Ccx (in fact, there is still resistance between the first loading device Csa and the second loading device Ccx). Therefore, the Csa and the Ccx are charged by the Vdd. Referring to FIG. 4B, the voltages of the Vsa and the Vcx are 5V which is the same as the voltage of Vdd. When the Vsa is provided for sensing voltage of the bit lines, the voltage of the gate B of the NMOS transistor M43 changes to high voltage level to enable the operation amplifier 41. The gate A of the NMOS transistor M45 changes to low voltage level to turn off the NMOS transistor M45. At this time, the gate of the. PMOS transistor M41 is connected to the operation amplifier 41 only. The Vsa goes down because of supplying the power for sensing the bit lines between $t_1$ and $t_2$. At this time, the charge flows to the bit lines from the Csa and the Ccx. When the Vsa is lower than the 2.7V, the operation amplifier 41 outputs a low voltage signal to turn on the PMOS transistor M41. At this time, which is before charging, supplying a high voltage level signal to the gate of the PMOS transistor M47 turns off the PMOS transistor M47. Since the Csa and the Ccx are separated by the transistor which is turned off, Vdd charges the Ccx and the Csa to increase the voltage to 5V and 2.7V respectively. between $t_3$ and $t_4$(referring to FIG. 4B). When the Vsa is higher than 2.7V, the operation amplifier 41 outputs a high voltage level to turn off the PMOS transistor M41 to stop the operation of charging the loading device Csa. As a result, the operation of charging Csa and the capacitor of the bit lines will causes the voltage of the Vsa raised to 2.7V between the $t_2$ and $t_3$. From $t_3$ to $t_4$, the Vsa is maintained at 2.7V. After $t_4$, because of the voltage of the gate B of the NMOS transistor M43 goes down to the low voltage level, the operation amplifier M41 is disabled. And when the voltage of the gate A of the NMOS transistor M45 goes up to the high voltage level, the NMOS transistor M45 and the PMOS transistor M41 are turned on to charge the Csa by Vdd. Since the PMOS transistor M47 is turned on to connected the Ccx and the Csa in parallel, the charges of the Csa and the Ccx are shared, so the voltage of the Ccx will go to the level of the vdd quickly.

At this time, the operation amplifier 41 is disabled, therefore the Vsa and the Vcx will be charged until they reach 5V (the voltage of Vdd.

Increasing the voltage level of the Vsa before supplying the power to the DRAM can prevent the Vsa dropping exceedingly low and makes it easier to charge the Vsa to 2.7V in time before the next sensing period of DRAM. However, the operation of the DRAM IC will be stopped if the Vsa is in an exceedingly low voltage.

The voltage regulator of the third embodiment of the present invention makes the Vsa level equal to 5V at equalization period. Therefore, there are more charge Q for sensing (wherein $Q=C\Delta V$, $\Delta V=V1-V2$, C is the total capacitance of the Csa and the capacitor of the bit lines, V1 is the value of Vsa before sensing and V2 is the minimum value of Vsa after sensing). Obviously, in order to keep the same charge Q and C, so that the $\Delta V$ will be the same. When V1 is increased, V2 will be increased in the same way. Therefore, it means that the second embodiment of the present invention can increase the minimum Vsa higher than the prior art. Because the present invention offers a higher minimum Vsa, the recovery time of the present invention is obviously shorter than the conventional design.

Furthermore, by controlling the loading of the voltage regulator, the recovery time is shorter and the minimum Vsa is higher. In the same manner, $Q=C\Delta V$ and $\Delta V=V1-V2$, when the PMOS transistor M47 is turned on, the Csa and the Ccx is connected in parallel, so the total capacitance is increasing (C=Csa+Ccx). Obviously, in order to keep the same charge Q, when the capacitance of the circuit is increasing, the $\Delta V$ should be decreased. So the minimum Vsa is increased by increasing the capacitance of the circuit when sensing. At the time when the Vdd charges the Csa, the PMOS transistor M47 is turned off to separate the Csa and the Ccx. Therefore, the recovery time will be decreased due to the increased minimum Vsa.

Fourth Embodiment

Figure 5A:
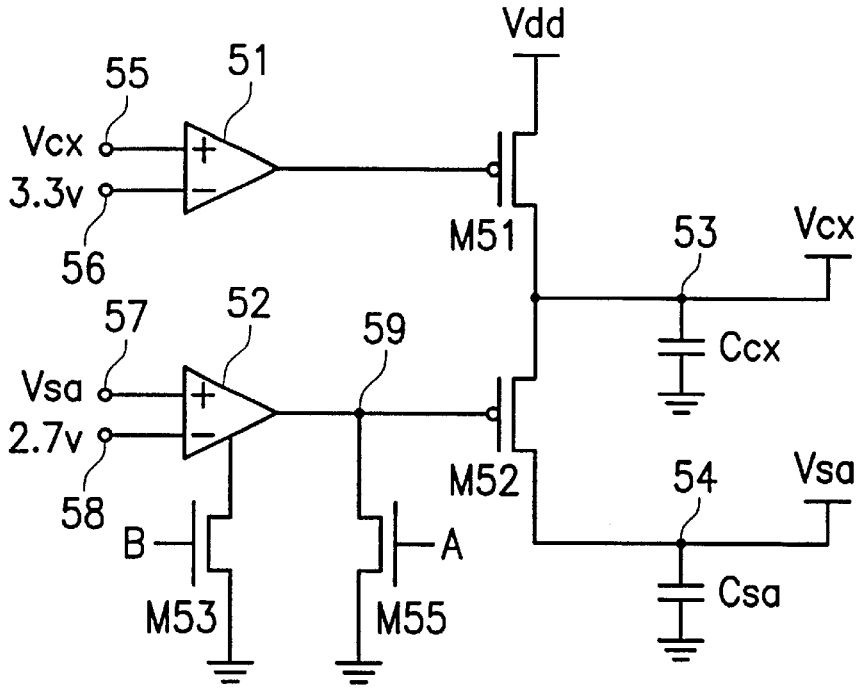
FIG. 5A shows a schematic circuit diagram illustrating the fourth embodiment of the present invention.

First, there is the description of the circuit structure of the fourth embodiment of the present invention. As shown in FIG. 5A, the operation amplifier 51 is connected to the PMOS transistor M51, which has the input terminal 55 and 56 for receiving the Vcx and the first reference voltage (of 3.3V for example) respectively, wherein the input terminal 55 is further connected to the node 53 to receive the voltage of the node 53 (referred to as Vcx hereinafter). The operation amplifier 51 is used for comparing the Vcx and the first reference voltage. When the Vcx is larger than 3.3V, the operation amplifier 51 outputs a high voltage level signal. And when the Vcx is lower than 3.3V, the operation amplifier 51 outputs a lower voltage level signal. The source of PMOS transistor M51 is used for receiving the output of the external power supply Vdd (of 5V for example), and the drain of the same is connected to the second loading device Ccx at the node 53. The second loading device Ccx is connected between the node 53 and the ground. Wherein the node 53 is connected to the input terminal 55 of the operation amplifier 51 and outputs Vcx. Furthermore, the second loading device Ccx is a capacitor.

The NMOS transistor M53 is a switch for controlling the operation of the operation amplifier 52. When the gate B of the NMOS M53 receives a high level signal, the operation amplifier 52 is enabled. On the contrary, when the gate B of the NMOS transistor M53 is in the low voltage level, the operation of the operation amplifier 52 is disabled. In the same manner, the NMOS transistor M55 is a switch, which is connected to the PMOS transistor M52. When the gate A of the NMOS transistor M55 receives a high voltage level signal, the NMOS transistor M55 will be turned on and makes the gate of the PMOS transistor M52 connect to the ground. When the gate A of the NMOS transistor M55 receives a low voltage level signal, the NMOS transistor M55 will be turned off and the gate of the PMOS transistor M52 is connected to the output of the operation amplifier 52 directly.

The operation amplifier 52 is connected to the PMOS transistor M52, which has the input terminal 57 and 58 for receiving the Vsa and the second reference voltage (of 2.7V for example) respectively, wherein the input terminal 57 is further connected to the node 54 to receive the voltage of the node 54. The operation amplifier 52 is used for comparing the Vsa and the second reference voltage. When the Vsa is larger than 2.7V, the operation amplifier 52 is in a high voltage level signal. And when the Vsa is lower than 2.7V, the operation amplifier 52 outputs a lower voltage level signal. The source of PMOS transistor M52 is connected to the node 53 for receiving the Vcx, and the drain of the same is connected to the first loading device Csa at the node 54. The first loading device Csa is connected between the node 54 and the ground. Wherein the node 54 is connected to the input terminal 57 of the operation amplifier 52 and outputs Vsa. Furthermore, the first loading device Csa is a capacitor.

Figure 5B:
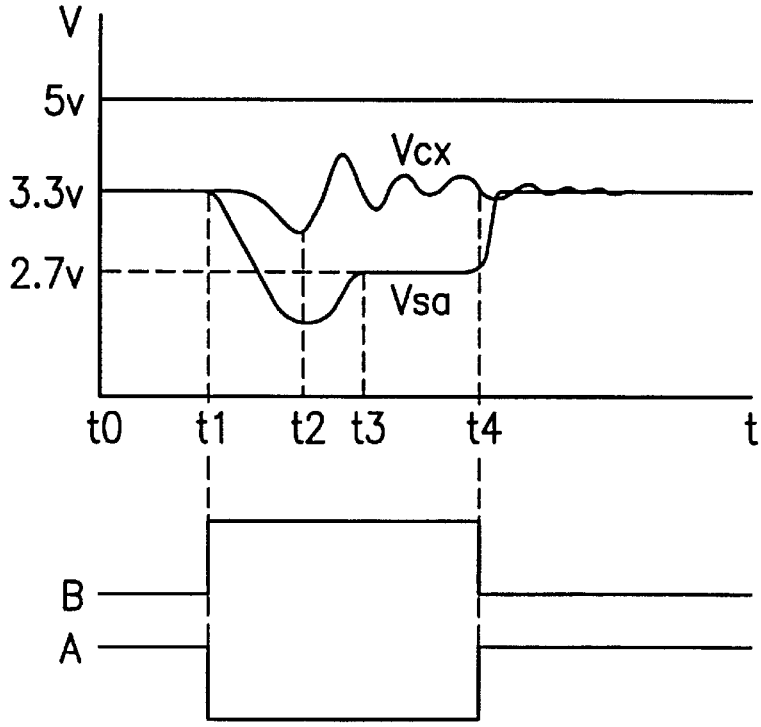
FIG. 5B schematically shows a graph in which output voltages are plotted against input voltages according to the fourth embodiment of the present invention.

Now, a description will be given to of the circuit of the fourth embodiment of the present invention. As shown in FIG. 5B, FIG. 5B shows a plot of the output voltage Vsa against the input voltages of the NMOS transistor M53 and M55.

Now describe the variation of the Vcx. The Vcx is used for charging the first loading device Csa. When the Vcx is larger than 3.3V, the output of the operation amplifier 51 may go higher and higher to decrease the Ids of the PMOS transistor M51, wherein the Ids is a current that flows from the source of the PMOS transistor M51 to the drain of the same, then less and less charge flows onto the Vcx. When the current Ids of the PMOS transistor M51 sunk from the Vcx, the Vcx will drop lower and lower, until it is lower than 3.3V, the output of the operation amplifier 51 will go lower to turn on the PMOS transistor M51 to let more charge flowing onto the Vcx. Referring to FIG. 5B, after charging the Csa (i.e. after to), the Vcx starts to decrease. After $t_2$, the Ccx is charged by 3.3V, but the Csa is still charged by the Vcx, it is observed that the value of Vsa oscillates, but it will converge to 3.3V finally.

Now describe the variation of the Vsa. First, the gate B of the NMOS transistor M53 is in the low voltage level, and the gate A of the NMOS transistor M55 is in the high voltage level. At this time, the operation amplifier 52 is disabled, and the PMOS transistor M52 is turned on because of the node 59 is in the low voltage level. Therefore, the loading device Csa is charged by the Vcx. Referring to FIG. 5B, the voltage of the Vsa is 3V which is the same with the voltage of Vcx. When the Vsa is provided for sensing voltage of the bit lines, the voltage of the gate B of the NMOS transistor M53 changes to high voltage level to enable the operation amplifier 52. The gate A of the NMOS transistor M55 changes to low voltage level to turn off the NMOS transistor M55. At this time, the gate of the PMOS transistor M52 is connected to the operation amplifier 52 only. The Vsa goes down because of supplying the power for sensing the bit lines between $t_1$ and $t_2$. When the Vsa is lower than the 2.7V, the operation amplifier 52 outputs a low voltage signal to turn on the PMOS transistor M52, so the Vdd charges the first loading device Csa to increase the voltage of the Vsa. When the Vsa is higher than 2.7V, the operation amplifier 52 outputs a high voltage level to turn off the PMOS transistor M52 to stop the operation of charging the first loading device Csa. As a result, the operation of charging Csa and the capacitor of the bit lines will causes the voltage of the Vsa raised to 2.7V between the $t_2$ and $t_3$. From $t_3$ to $t_4$, the Vsa is maintained at 2.7V. After $t_4$, because of the voltage of the gate B of the NMOS transistor M53 goes down to the low voltage level, the operation amplifier M52 is disabled. And when the voltage of the gate A of the NMOS transistor M55 goes up to the high voltage level, the NMOS transistor M55 and the PMOS transistor M52 are turned on to charge the Csa by Vcx. At this time, the operation amplifier 52 is disabled, so the Vsa will be charging till 3.3V (the voltage of Vcx).

In this embodiment, the Vcx is used as the voltage source of the Csa for the following reasons: when the Vdd is increased, the Vcx also increases slightly but it's more moderately than Vdd. Therefore, by using the Vcx as the charging voltage for Csa, the Vcx will be less dependent on Vdd than Vsa. Therefore, the present invention employs the concept of the two-stage stable status for adjusting the output voltage, which causes a more stable output voltage. However, as described above, the two-state stable status is just used as an example, actually, having more states will make the output of the regulator to be more stable.

Increasing the voltage level of the Vsa before supplying the power to the DRAM can prevent the Vsa dropping exceedingly low and makes it easier to charge the Vsa to 2.7V in time before the next sensing period of DRAM. However, the operation of the DRAM IC will be stopped if the Vsa is in an exceedingly low voltage.

The voltage regulator of the fourth embodiment of the present invention makes the Vsa level equal to 3.3V at equalization period. Therefore, there are more charge Q for sensing (wherein $Q=C\Delta V$, $\Delta V=V1-V2$, C is the total capacitance of the Csa and the capacitor of the bit lines, V1 is the value of Vsa before sensing and V2 is the minimum value of Vsa after sensing). Obviously, in order to keep the same charge Q and C, so that the $\Delta V$ will be the same. When V1 is increased, V2 will be increased in the same way. Therefore, it means that the second embodiment of the present invention can increase the minimum Vsa higher than the prior art. Because the present invention offers a higher minimum Vsa, the recovery time of the present invention is obviously shorter than the conventional design.

Fifth Embodiment

Figure 6A:
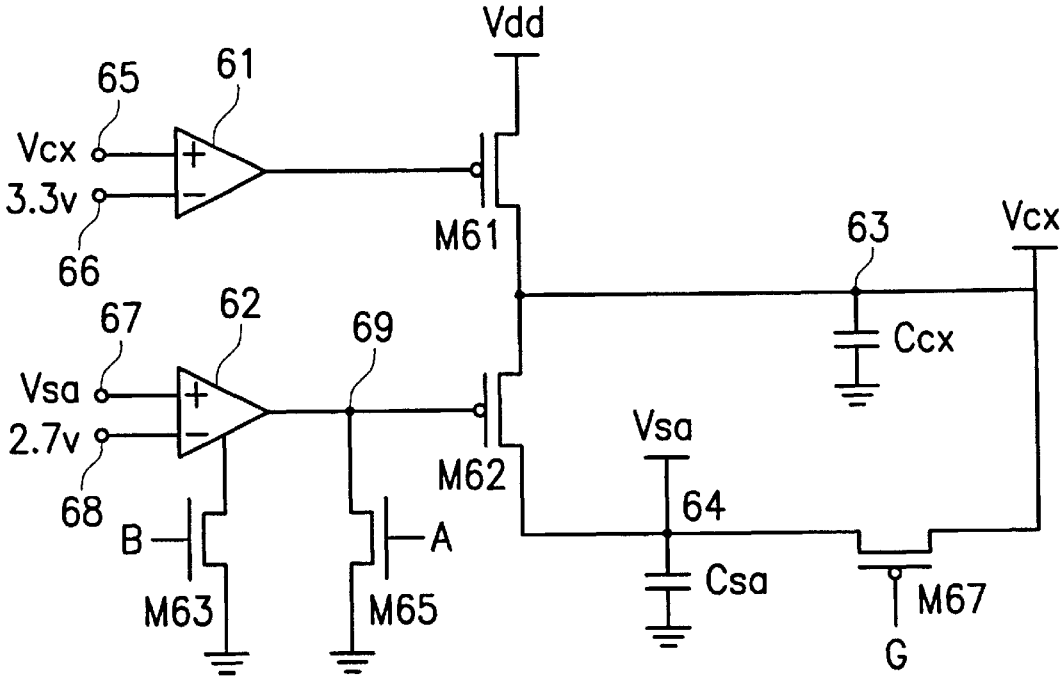
FIG. 6A shows a schematic circuit diagram illustrating the fifth embodiment of the present invention.

The circuit structure according to the fifth embodiment of the present invention is described as follows. As shown in FIG. 6A, the operation amplifier 61 is connected to the PMOS transistor M61, which has the input terminal 65 and 66 for receiving the Vcx and the first reference voltage (of 3.3V for example), respectively, wherein the input terminal 65 is further connected to the node 63 to receive the voltage of the node 63 (referred to as Vcx hereinafter). The operation amplifier 61 is used for comparing the Vcx and the first reference voltage. When the Vcx is larger than 3.3V, the operation amplifier 61 outputs a high voltage level signal. And when the Vcx is lower than 3.3V, the operation amplifier 61 outputs a lower voltage level signal. The source of the PMOS transistor M61 is used for receiving the output of the external power supply Vdd (of 5V, for example), and the drain of the PMOS transistor M61 is connected to a second loading device Ccx at the node 63. The second loading device Ccx is connected between the node 63 and the ground. Wherein, the node 63 is connected to the input terminal 65 of the operation amplifier 61 and outputs Vcx, and the second loading device Ccx is a capacitor.

The NMOS transistor M63 is a switch for controlling the operation of the operation amplifier 62. As soon as the gate B of the NMOS M63 receives a high level signal, the operation amplifier 62 is enabled. On the contrary, as soon as the gate B of the NMOS transistor M63 is in the low voltage level, the operation of the operation amplifier 62 is disabled. In the same manner, the NMOS transistor M65 is a switch, which is connected to the node 69 between the PMOS transistor M62 and the operation amplifier 62. As soon as the gate A of the NMOS transistor M65 receives a high voltage level signal, the NMOS transistor M65 is turned on to make the gate of the PMOS transistor M62 connected to the ground. As soon as the gate A of the NMOS transistor M65 receives a low voltage level signal, the NMOS transistor M65 is turned off and the gate of the PMOS transistor M62 is connected to the output of the operation amplifier 62 directly.

The operation amplifier 62 is connected to the PMOS transistor M62, which has the input terminal 67 and 68 for receiving the Vsa and the second reference voltage (of 2.7V for example), respectively, wherein the input terminal 67 is further connected to the node 64 to receive the voltage of the node 64. The operation amplifier 62 is used for comparing the Vsa and the second reference voltage. When the Vsa is larger than 2.7V, the operation amplifier 62 outputs a high voltage level signal. And when the Vsa is lower than 2.7V, the operation amplifier 62 outputs a lower voltage level signal. The source of the PMOS transistor M62 is connected to the node 63 for receiving the Vcx, and the drain of the PMOS transistor M62 is connected to the first loading device Csa at the node 64. The first loading device is connected between the node 64 and the ground. Wherein the node 64 is connected to the input terminal 67 of the operation amplifier 62 and outputs Vsa. Furthermore, the first loading device Csa is a capacitor.

The PMOS transistor M67 is a switch between the the node 63 and 64. When the gate of the PMOS transistor M67 receives a low voltage signal, the PMOS transistor M67 will be turned on and make the first loading device Csa and the second loading device Ccx are connected in parallel. On the contrary, when the gate of the PMOS transistor M67 receives a high voltage signal, the PMOS transistor M67 will be turned off and separate the first loading device Csa and the second loading device Ccx. Therefore, the first loading device Csa is charged by the Vdd via the PMOS transistor M62 and the second loading device Ccx is charged by the Vdd via the PMOS transistor M61.

Figure 6B:
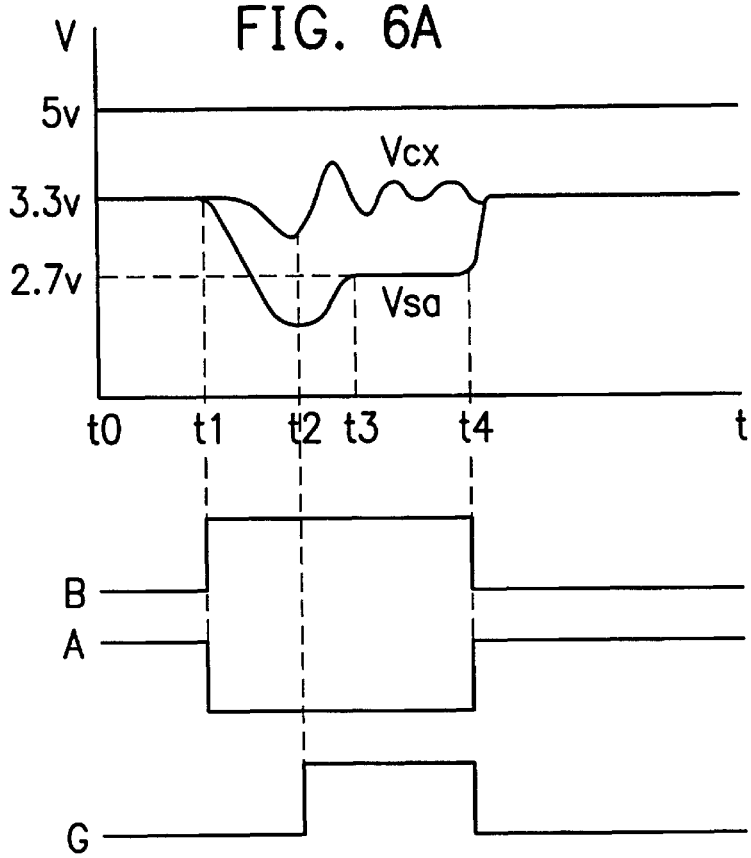
FIG. 6B schematically shows a graph in which output voltages are plotted against input voltages according to the fifth embodiment of the present invention.

Now, a description will be given to the circuit of the fifth embodiment of the present invention. As shown in FIG. 6B, it shows a plot of the output voltage Vsa against the input voltages of the NMOS transistor M63, M65 and the PMOS transistor M67.

Now describe the variation of the Vcx. The Vcx is used for charging the first loading device Csa. When the Vcx is larger than 3.3V, the output of the operation amplifier 61 may go higher and higher to decrease the Ids of the PMOS transistor M61, wherein the Ids is a current that flows from the source of the PMOS transistor M61 to the drain of the PMOS transistor M61, then less and less charge flows onto the Vcx. When the current Ids of the PMOS transistor M61 sunk from the Vcx, the Vcx will drop lower and lower, until it is lower than 3.3V, the output of the operation amplifier 61 will go lower to turn on the PMOS transistor M61 to let more charge flowing onto the vcx. Referring to FIG. 6B, after charging the Csa (i.e. after $t_1$), the Vcx starts to decrease. After $t_2$, the Ccx is charged by 3.3V, but the Csa is still charged by the Vcx, it is observed that the value of Vsa oscillates, but it will converge to 3.3V finally.

Now describe the variation of the Vsa. First, the gate B of the NMOS transistor M63 is in the low voltage level, the gate A of the NMOS transistor M65 is in the high voltage level, and the gate G of the PMOS transistor M67 is in the low voltage level. At this time, the operation amplifier 61 is disabled, and the PMOS transistor M62 is turned on because, of the node 69 is in the low voltage level. Furthermore, the gate G of the PMOS transistor M67 is in the low voltage level, hence the PMOS transistor M67 is turned on and results in the parallel connection of the first loading device Csa and the second loading device Ccx (in fact, there is still resistance between the first loading device Csa and the second loading device Ccx). Therefore, the Csa and the Ccx are charged by the Vdd. Referring to FIG. 6B, the voltages of the Vsa and the Vcx are 3.3V which is the same as the voltage of the, first reference voltage between $t_0$ and $t_1$. When the Vsa is provided for sensing voltage of the bit lines, the voltage of the gate B of the NMOS transistor M63 changes to high voltage level to enable the operation amplifier 61. The gate A of the NMOS transistor M65 changes to low voltage level to turn off the NMOS transistor M65. At this time, the gate of the PMOS transistor M62 is connected to the operation amplifier 62 only. The Vsa goes down because of supplying the power for sensing the bit lines between $t_1$ and $t_2$. At this time, the charge flows to the bit lines from the Csa and the Ccx. When the Vsa is lower than the 2.7V, the operation amplifier 62 outputs a low voltage signal to turn on the PMOS transistor M62. At this time, which is before charging, supplying a high voltage level signal to the gate of the PMOS transistor M67 turns off the PMOS transistor M67. Since the Csa and the Ccx are separated by the transistor which is turned off, Vdd charges. the Ccx and the Csa to increase the voltage to 5V and 2.7V respectively between $t_3$ and $t_4$(referring to FIG. 6B). When the Vsa is higher than 2.7V, the operation amplifier 62 outputs a high voltage level signal to turn off the PMOS transistor M62 to stop the operation of charging the loading device Csa. As a result, the operation of charging Csa and the capacitor of the bit lines will causes the voltage of the Vsa raised to 2.7V between the $t_2$ and $t_3$. From $t_3$ to $t_4$, the Vsa is maintained at 2.7V. After $t_4$, because of the voltage of the gate B of the NMOS transistor M63 goes down to the low voltage level, the operation amplifier M62 is disabled. And when the voltage of the gate A of the NMOS transistor M65 goes up to the high voltage level, the NMOS transistor M65 and the PMOS transistor M62 are turned on to charge the Csa by Vcx. Since the PMOS transistor M67 is turned on to connected the Ccx and the Csa in parallel, the charges of the Csa and the Ccx are shared, so the voltage of the Csa will goes to the level of the Vcx quickly.

At this time, the operation amplifier 62 is disabled, therefore the Vsa and the Vcx will be charged until they reach 3.3V(the voltage of Vcx).

In this embodiment, the Vcx is used as the voltage source of the Csa for the following reasons: when the Vdd is increased, the Vcx also increases slightly but it's more moderately than Vdd. Therefore, by using the Vcx as the charging voltage for Csa, the Vcx will be less dependent on Vdd than Vsa. Therefore, the present invention employs the concept of the two-stage stable status for adjusting the output voltage, which causes a more stable output voltage. However, as described above, the two-state stable status is just used as an example, actually, having more states will make the output of the regulator to be more stable.

Increasing the voltage level of the Vsa before supplying the power to the DRAM can prevent the Vsa dropping exceedingly low and makes it easier to charge the Vsa to 2.7V in time before the next sensing period of DRAM. However, the operation of the DRAM IC will be stopped if the Vsa is in an exceedingly low voltage.

The voltage regulator of the fifth embodiment of the present invention makes the Vsa level equal to 3.3V at equalization period. Therefore, there are more charge Q for sensing(wherein $Q=C\Delta V$, $\Delta V=V1-V2$, C is the total capacitance of the Csa and the capacitor of the bit lines, V1 is the value of Vsa before sensing and V2 is the minimum value of Vsa after sensing). Obviously, in order to keep the same charge Q and C, so that the $\Delta V$ will be the same. When V1 is increased, V2 will be increased in the same way.

Therefore, it means that the second embodiment of the present invention can increase the minimum Vsa higher than the prior art. Because the present invention offers a higher minimum Vsa, the recovery time of the present invention is obviously shorter than the conventional design.

Furthermore, by controlling the loading of the voltage regulator, the recovery time is shorter and the minimum Vsa is higher. In the same manner, $Q=C\Delta V$ and $\Delta V=V1-V2$, when the PMOS transistor M67 is turned on, the Csa and the Ccx is connected in parallel, so the total capacitance is increasing(C=Csa+Ccx). Obviously, in order to keep the same charge Q, when the capacitance of the circuit is increasing, the $\Delta V$ should be decreased. So the minimum Vsa is increased by increasing the capacitance of the circuit when sensing. At the time when the Vdd charges the Csa, the PMOS transistor M67 is turned off to separate the Csa and the Ccx. Therefore, the recovery time will be decreased due to the increased minimum Vsa.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A voltage regulator comprising:

a first switch device disposed between a voltage source and a first voltage node;

a first comparative device for comparing a first voltage at said first voltage node and a first reference voltage, turning on said first switch device when said first voltage is less than said first reference voltage, otherwise turning off said first switch device, whereby said first voltage is regulated to said first reference voltage;

a second switch device disposed between said first voltage node and a second voltage node;

a second comparative device for comparing a second voltage at said second voltage node and a second reference voltage, turning on said second switch device when said second voltage is less than said second reference voltage, otherwise turning off said second switch device, where said second voltage is regulated to said second reference voltage;

a first control device for controlling said second comparative device between an enabled state and a disabled state;

a second control device for turning on said second switch device when said second comparative device is disabled; and a third control device for controlling said first voltage node and said second voltage node between parallel and open, whereby said first voltage node and said second voltage node charge share when parallel;

wherein said second voltage is less than said first voltage and said second reference voltage is less than said first reference voltage.

2. The voltage regulator as claimed in claim 1, wherein said second switch device is a PMOS transistor.

3. The voltage regulator as claimed in claim 1, wherein said first switch device is a NMOS transistor.

4. The voltage regulator as claimed in claim 1, wherein said first comparative device is an operation amplifier.

5. The voltage regulator as claimed in claim 1, wherein said second switch device is a NMOS transistor.

6. The voltage regulator as claimed in claim 1, wherein said first comparative device is an operation amplifier.

7. The voltage regulator as claimed in claim 1, wherein said second comparative device is an operation amplifier.

8. The voltage regulator as claimed in claim 1, wherein said first control device is a PMOS transistor.

9. The voltage regulator as claimed in claim 1, wherein said first control device is a NMOS transistor.

10. The voltage regulator as claimed in claim 1, wherein said second control device is a PMOS transistor.

11. The voltage regulator as claimed in claim 1, wherein said second control device is a NMOS transistor.

12. The voltage regulator as claimed in claim 1, wherein said third control device is a PMOS transistor.

13. The voltage regulator as claimed in claim 1, wherein said third control device is a NMOS transistor.

* * * * *